US006082564A

United States Patent [19]

Trout

[11] Patent Number: 6,082,564

[45] Date of Patent: Jul. 4, 2000

[54] KEY ACTUATED LOCKING CAP

[76] Inventor: Brett J. Trout, 12823 Clark, Clive, Iowa 50325

[21] Appl. No.: 08/899,910

[22] Filed: Jul. 29, 1997

[51] Int. Cl.[7] ..... B65D 55/14

[52] U.S. Cl. ..... 215/207; 215/215; 215/216; 215/302; 220/255; 220/210; 220/284

[58] Field of Search ..... 215/201, 204, 215/207, 295, 303, 305, 215, 219, 216, 302, 218; 220/255, 210, 284

[56] References Cited

U.S. PATENT DOCUMENTS

| | | | |
|---|---|---|---|
| 2,428,782 | 10/1947 | Browne | 215/302 X |
| 3,021,034 | 2/1962 | Maack | 215/302 X |
| 3,097,756 | 7/1963 | Dorsey | 215/215 |
| 3,099,361 | 7/1963 | Ruetz | 215/295 X |
| 3,160,301 | 12/1964 | Milbourne | 215/219 |
| 3,370,731 | 2/1968 | Ehrbar | 215/215 |
| 3,843,008 | 10/1974 | Colella | 215/207 X |
| 3,944,102 | 3/1976 | Grau . | |
| 3,950,917 | 4/1976 | Choksi et al. | 215/204 X |
| 4,014,449 | 3/1977 | Hadley et al. | 215/219 X |
| 4,664,288 | 5/1987 | Pereira et al. | 215/207 X |
| 4,690,292 | 9/1987 | Henning | 215/201 |
| 4,854,459 | 8/1989 | DeJonge | 215/219 X |
| 4,997,096 | 3/1991 | Kusz | 215/201 |
| 5,027,954 | 7/1991 | Hickerson | 215/201 |
| 5,158,194 | 10/1992 | Sirgo et al. | 215/215 X |
| 5,386,924 | 2/1995 | Flinta et al. | 215/207 X |
| 5,433,329 | 7/1995 | Weinstein | 215/219 X |
| 5,445,283 | 8/1995 | Kratukramer | 215/218 |
| 5,524,779 | 6/1996 | Faile | 215/207 |
| 5,586,670 | 12/1996 | Greenwald | 215/207 |
| 5,769,252 | 6/1998 | Volpe | 215/207 X |

*Primary Examiner*—Stephen K. Cronin
*Assistant Examiner*—Robin A Hylton
*Attorney, Agent, or Firm*—Brett J. Trout; Gunderson, Weindruch, Trout & Rhein, P.C.

[57] ABSTRACT

A secured container closure system is provided for preventing access to the container's contents by small children while allowing ease of access to the container contents by persons of limited strength or dexterity. The system is provided with a first cap having a smooth exterior and being provided with a catch. The first cap is provided within a second cap which has an opening which allows access to the catch. Both the exterior of the first cap and the interior of the second cap are smooth to reduce torque transfer between the second cap and the first cap. A key is provided which may be extended through the opening and engaged to the catch to allow torque transfer between the second cap and first cap for either opening or closing the container. The key may be of an extended length or secured to a wall to allow greater leverage in opening or closing the container.

8 Claims, 4 Drawing Sheets

KEY ACTUATED LOCKING CAP

BACKGROUND OF THE INVENTION

1. Field of the Invention

The present invention relates in general to a protective cap which frustrates removal by children and the like, and, more specifically, to a safety cap which is readily opened by persons lacking strength and dexterity.

2. Description of the Prior Art

While prescription medicines and household cleansers can be very beneficial when used as directed, they are often poisonous or even fatal when ingested by small children. Accordingly, it is desirable to provide a lockable cap for containers of such cleansers and prescriptions to prevent access to the contents of the container by unattended small children. Competing with the desirability of preventing children from having easy access to such containers, is the desirability of allowing easy access by older persons or handicapped persons who may lack either the strength or dexterity to open containers provided with safety caps of the prior art.

Prior art safety caps are generally one of two types. The first type is a "snap-on" cap which has an interior flange. The interior cap flange snaps onto a flange provided around the exterior of the bottle neck. The exterior flange is provided with a break to accommodate a boss which is located on the interior of the cap. The exterior of the cap is provided with an arrow indicating the position of the boss. The bottle neck is provided with an arrow which indicates the break in the bottle neck flange.

Due to the size of the boss, it is extremely difficult to force the boss over the bottleneck flange and remove the cap. Accordingly, when it is desired to remove the cap, the arrows are lined up and the cap may be removed by moving the boss past the break in the bottle neck flange. While this type of protective closure works well at preventing inadvertent or undesired opening by a small child, the closure causes difficulty for persons lacking the strength and/or dexterity to remove the cap.

The second type of protective closure involves a dual cap having an interior portion and an exterior portion. In the typical embodiment, the top exterior of the interior portion and the top interior of the exterior portion are provided with catches and grooves. These catches and grooves provide for torque transfer between the exterior portion and interior portion when the cap is being tightened. When the cap is being loosened, the torque transfer is accomplished only when the cap is being forced downward while being rotated. Again, while this type of protective cap prevents undesired access to the container by small children, the cap is difficult to remove for persons lacking strength or dexterity. This is especially true if the cap becomes overtightened.

Although the above-described devices are adapted to provide access to a container by adults, while preventing access by children, none of these devices allow for access by people possessing only minimal dexterity and/or strength. The present invention is designed to prevent container access by small children while allowing access to adults having only minimal dexterity or strength.

SUMMARY OF THE INVENTION

Accordingly, it is an object of the present invention to provide a container which allows ready access by persons having only minimal strength or dexterity.

Another object of the present invention is to provide a protective closure which prevents access to a container by infants and small children.

A further object of the present invention is to provide a protective cap which is inexpensive to manufacture.

Still another object to the present invention is to provide a protective cap which may be adapted to currently used bottleneck designs.

These and other objects of the invention, will become apparent upon reference to the following specification, drawings and claims.

By the present invention it is proposed to overcome the difficulties encountered heretofore. To this end, a container is provided having at least one opening. Also provided is a first cap having a catch and capable of being secured over the container opening. A second cap is also provided and is capable of being secured over the first cap, wherein the second cap is provided with an opening capable of being aligned with the catch on the first cap. Also provided is a key having a first end capable of being grasped by a user and a second end of a construction capable of extending through the opening of the second cap and engaging the catch provided on the first cap.

In the preferred embodiment, the container is provided with a threaded neck which allows the first cap to be screwed onto the container. Preferably the second cap is provided with a lip which prevents removal of the first cap from the second cap once the second cap is provided over the first cap. Additionally, the first cap is preferably provided with a smooth exterior surface and the second cap is provided with a smooth interior surface which substantially eliminate torque transmission between the second cap and the first cap when the second cap is secured to the container and the second cap is twisted in the direction required to remove the first cap.

Preferably, the key is a resilient wire capable of extending through the second cap to engage the catch of the first cap, thereby allowing torque transmission between the first cap and the second cap when it is desired to remove the first cap from the container.

DETAILED DESCRIPTION OF THE PREFERRED EMBODIMENT

Figure 1:
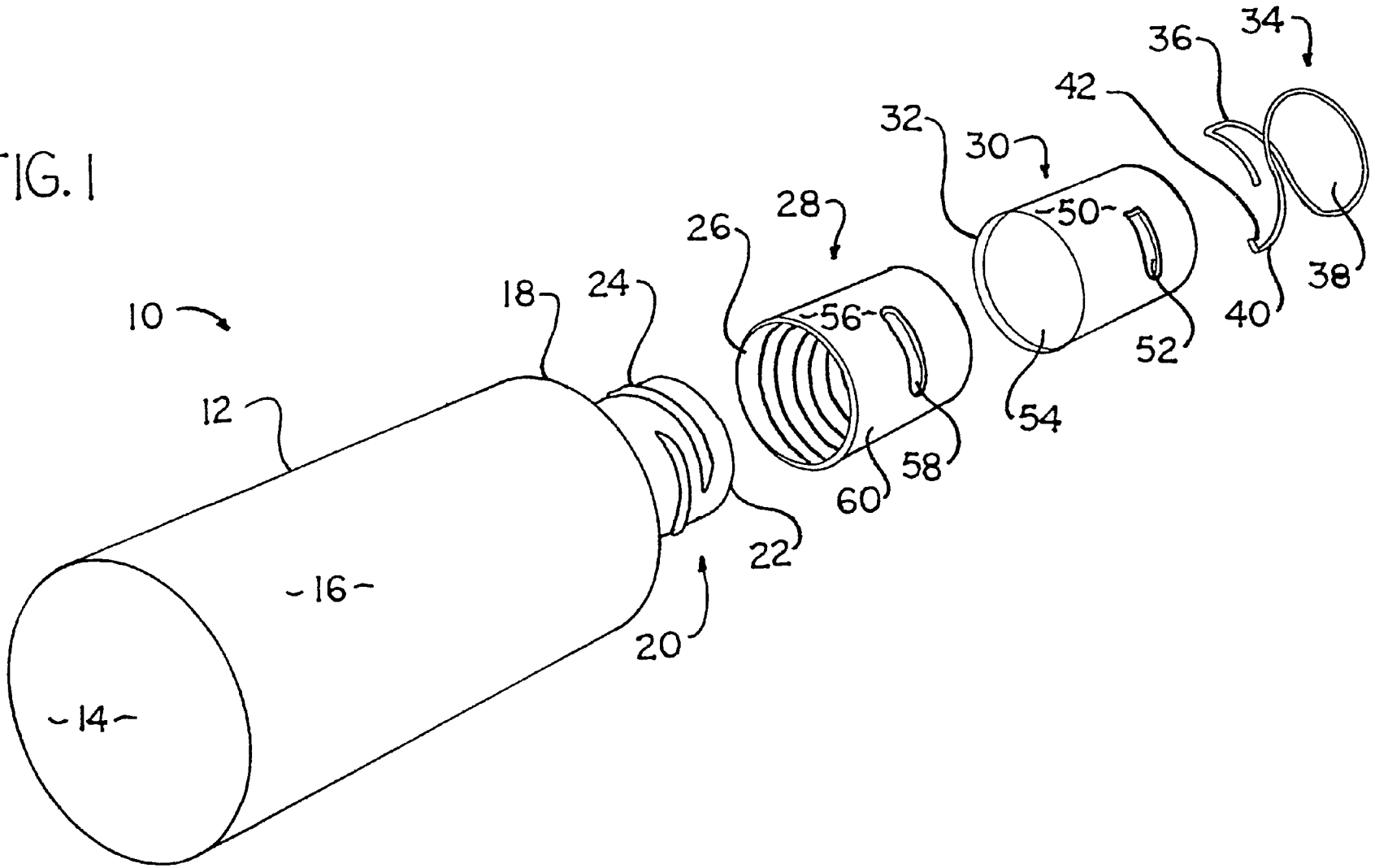
FIG. 1 is an exploded perspective view of a preferred embodiment of the safety closure of the present invention.

With reference to the drawings, a protectively capped container and key assembly are indicated generally as 10 in FIG. 1. As shown, the apparatus 10 includes a container 12 having a base 14, a body 16, a shoulder 18, a neck 20, and a mouth 22. The neck 20 is provided with threads 24 which mate with threads 26 provided on an interior surface of an interior cap 28. The threads 26 may be of any suitable dimensions, but preferably are designed to fit into mating alignment with threads on the most commonly used medicine bottles (not shown).

Provided over the interior cap 28 is an exterior cap 30 secured to the interior cap 28 by a flange 32 provided circumfrentially along one end of the exterior cap 30. Also shown in FIG. 1 is a key 34 having a cap engager 36, a finger hole 38, a resilient arm 40 and a lock pin 42.

Figure 2A:
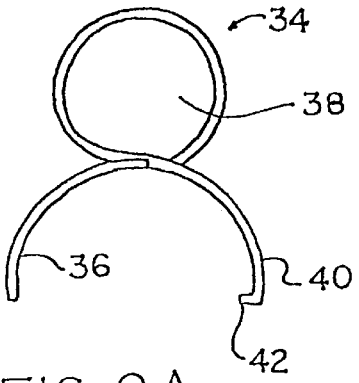
FIG. 2A is a side elevation showing the key of FIG. 1.
Figure 2B:
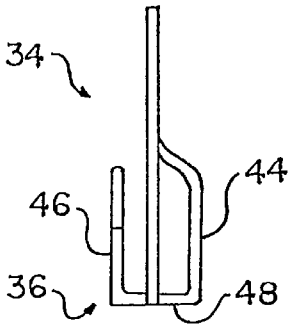
FIG. 2B is a front elevation showing the key of FIG. 1.

As shown in FIGS. 2A–B, the key 34 is constructed of a single piece of inexpensive steel wire having a diameter of approximately two millimeters. While the key 34 may be provided with any desired dimensions to accommodate various size fingers and caps, the lock pin 42 is preferably angled perpendicular relative to a line tangent to the curve of the resilient arm 40. Additionally, while the cap engager 36 is shown with a first arm 44 and a second arm 46 connected by a shoulder 48 to provide the key 34 with added stability when it is applied to the exterior cap 30, it should be noted that the cap engager 36 may be constructed of only a single arm or may be eliminated altogether (FIGS. 1–2B).

Figure 3:
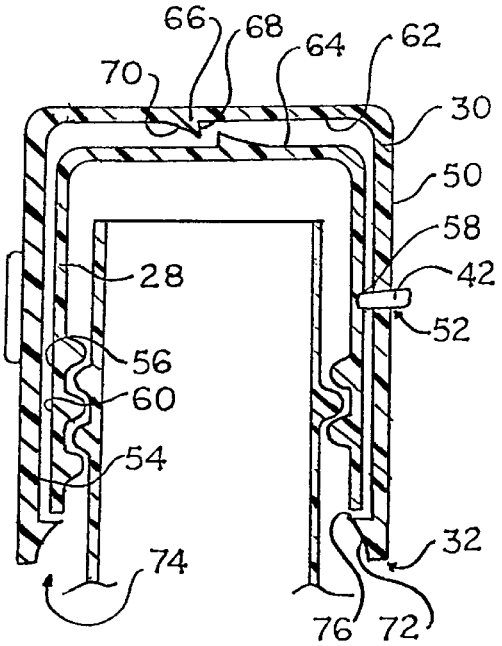
FIG. 3 is a side elevation in cross-section showing the first and second caps attached to the container and the key extending through the second cap to engage the first cap.

As shown in FIGS. 1 and 3, the exterior cap 30 is provided on its circumference 50 with a rounded rectangular slot 52. The exterior cap 30 is preferably constructed of inexpensive plastic and provided with a smooth interior surface 54. The interior cap 28 is provided along its circumference 56 with a rounded rectangular indentation 58 (FIG. 1). The interior cap 28 is preferably constructed of plastic and provided with a smooth exterior surface 60. As shown in FIG. 3, the interior top 62 of the exterior cap 30 and the exterior top 64 of the interior cap 28 may each be provided with a sloped one-way catches 66. The sloped one-way catches 66 have sloped triangular cross-sections, both with engaging surfaces 68 and sloped surfaces 70.

Accordingly, when the exterior cap 30 is rotated in a first direction relative to the interior cap 28, preferably clockwise, the engaging surfaces 68 of the sloped one-way catches 66 contact one another thereby transmitting torque between the exterior cap 30 and the interior cap 28. Conversely, when the exterior cap 30 is twisted in a second direction relative to the interior cap 28, preferably counterclockwise, the sloped surfaces 70 of the catches 66 slide up and over one another to prevent the transfer of torque between the exterior cap 30 and the interior cap 28. This orientation of the catches 66 allows manual attachment of the interior cap 28 to the neck 20 of the container 12 by twisting the exterior cap 30, while preventing manual removal of the interior cap 20 by twisting the exterior cap 30. In this way, anyone, including a small child can tighten the interior cap 28 onto the neck 20 of the container, while manual removal of the interior cap 28 is prevented.

As shown in FIG. 3, the circumference 56 of the inner cap 28 is slightly smaller than the interior surface 54 of the exterior cap 30 allowing the interior cap 28 to fit within the exterior cap 30. The flange 32 of the exterior cap 30 is preferably provided with a sloped surface 72 which extends inward to create an opening 74 in the exterior cap 30 of a diameter slightly smaller than the exterior diameter of the interior cap 28. The sloped surface 72 allows the interior cap 28 to be inserted into the exterior cap 30 despite the narrowness of the opening 74 in the exterior cap 30. Resilient construction of both the interior cap 28 and exterior cap 30 allows the caps to be deformed slightly during insertion. Once the interior cap 28 has been positioned completely within the exterior cap 30 the caps 28 and 30 return to their original shape. In addition to the sloped surface 72, the flange 32 is provided with a shelf 76 which supports the interior cap 28 and prevents removal of the interior cap 28 from the exterior cap 30.

The interior cap 28 and exterior cap 30 are preferably constructed so that once the interior cap 28 is placed within the exterior cap 30, the exterior cap 30 may be rotated relative to the interior cap 28 to a position where the rounded rectangular slot 52 of the exterior cap aligns with the rounded rectangular indentation 58 of the interior cap 28. Due to the smooth interior surface 54 of the exterior cap 30 and the smooth exterior surface 60 of the interior cap 28, it is not possible to remove the cap assembly 78 from the neck 20 of the container 12 by simply rotating the exterior cap 30.

Figure 4:
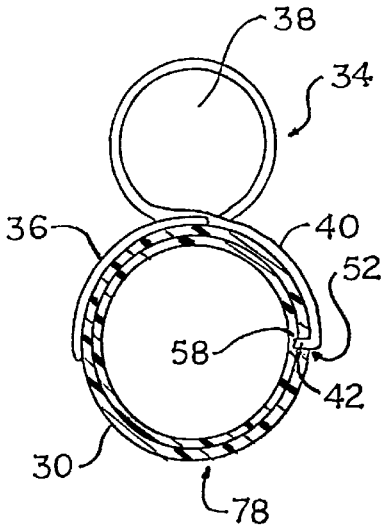
FIG. 4 is an underside view in partial cross-section showing the key extending through the second cap and engaging the first cap.
Figure 5:
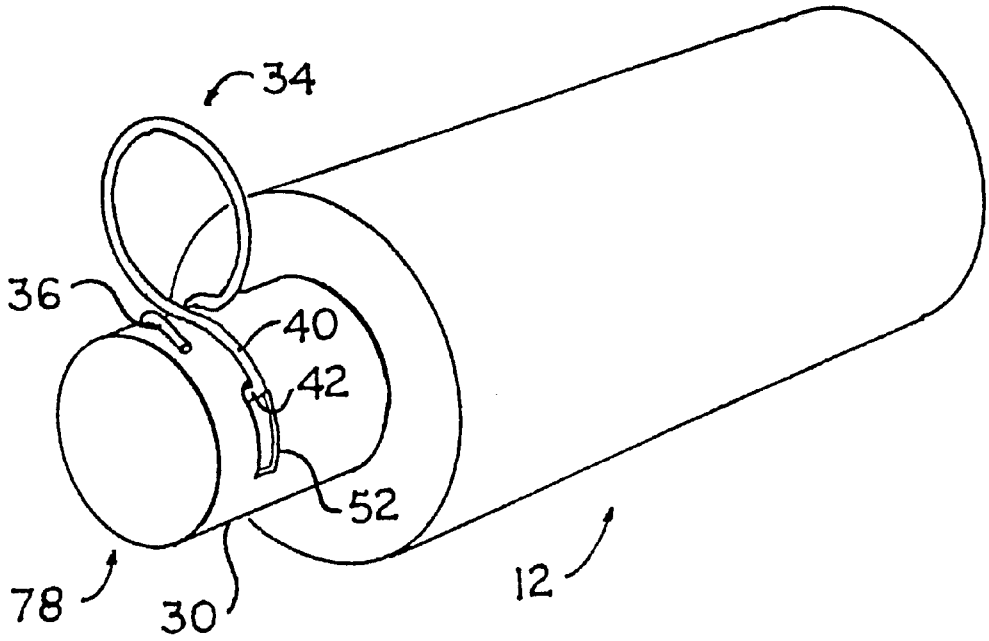
FIG. 5 is a perspective view showing the key extending through the second cap to engage the first cap for rotation in a counterclockwise direction to remove the cap from the container.

To remove the cap assembly 78, the lock pin 42 of the key 34 is positioned within the rounded rectangular slot 52 of the exterior cap 30 and the key 34 is rotated by the finger hole 38 until the rounded rectangular slot 52 is aligned with the rounded rectangular indentation 58 of the interior cap 28 (FIG. 4). At this point, the resilient arm 40 moves the lock pin 42 into engagement with the perimeter of the rounded rectangular indentation 58 as shown in FIGS. 4 and 5. The cap engager 36 acts to stabilize the key 34 against the exterior cap 30 to prevent inadvertent removal of the lock pin 42 from the rounded rectangular slot 52.

Figure 6:
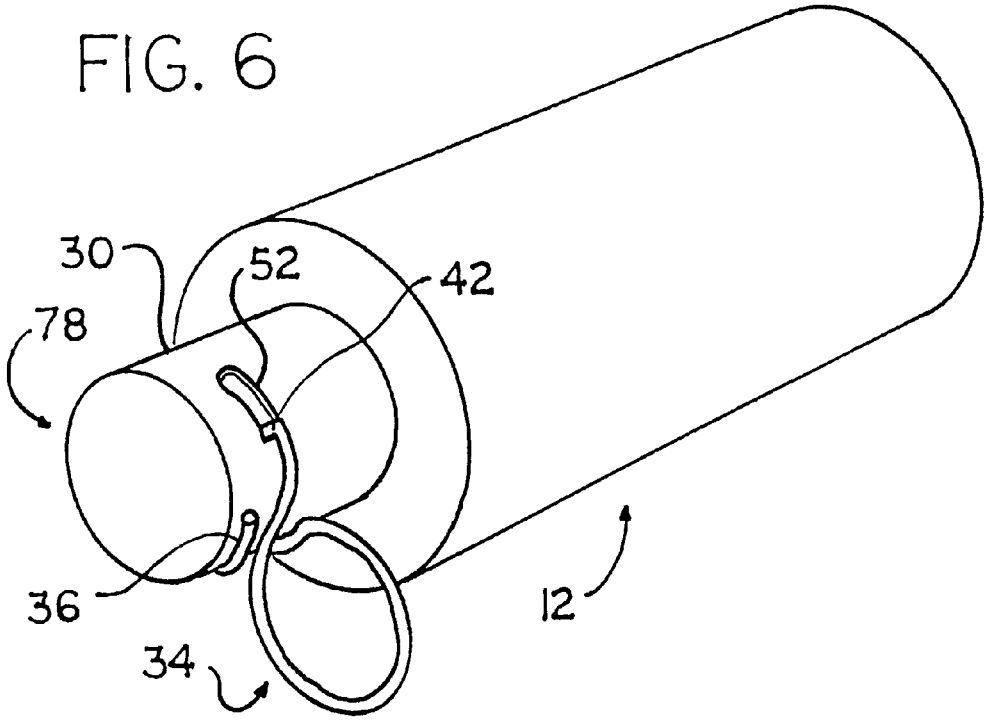
FIG. 6 is perspective view showing the key extending through the second cap to engage the first cap for rotation in a clockwise direction to secure the first cap to the container.

If it is desired to loosen the cap assembly 78, the key is oriented as shown in FIG. 5 and rotated in a counterclockwise orientation. Conversely, if it is desired to secure the cap assembly 78, the key 34 is oriented as shown in FIG. 6 and rotated in a clockwise direction.

Figure 7:
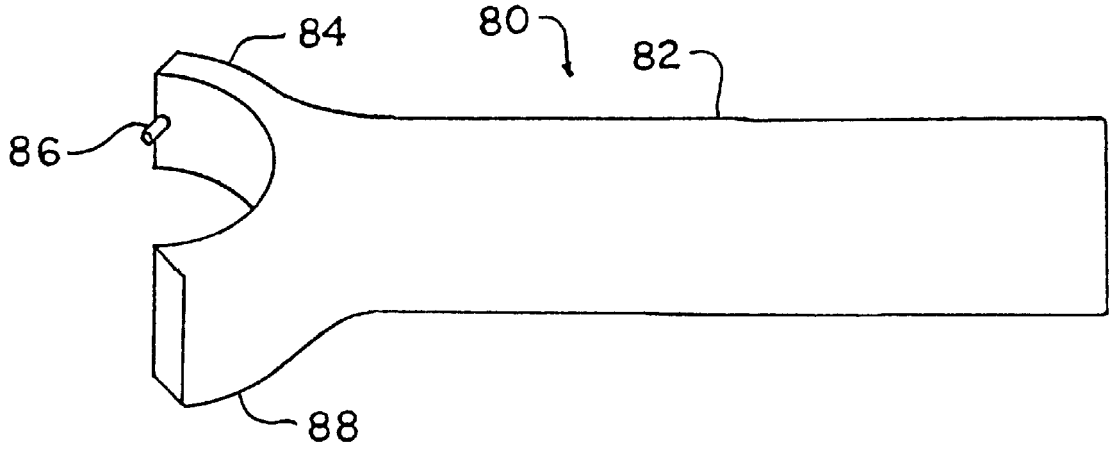
FIG. 7 is a perspective view of an alternative key of the present invention.

An alternative embodiment of the key is indicated generally as 80 in FIG. 7. In this embodiment of the invention, the key 80 is provided with a handle 82, a resilient arm 84 and a lock pin 86. The resilient arm 84 and the lock pin 86 are substantially similar to those described above in the preferred embodiment. The handle 82, however, is preferably a one piece molded plastic part provided with a molded-in cap engager 88. The resilient arm 84 may be molded directly into the handle 82, or may be attached by adhesive or similar securement means. Although the handle 82 of the alternative embodiment of the key 80 is significantly larger than the finger hole 38 of the preferred embodiment of the key 34, the greater length, allows a greater amount of leverage to be applied to a cap assembly 78 as the cap assembly 78 is being loosened and tightened (FIGS. 5 and 7).

Figure 8:
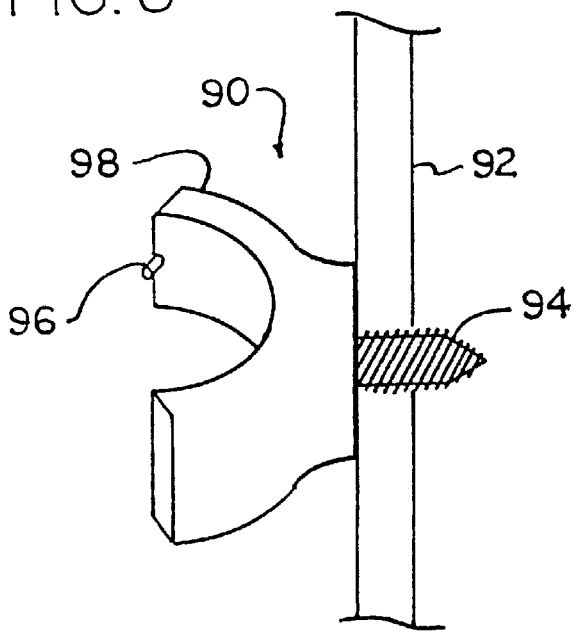
FIG. 8 is a perspective view of another alternative embodiment of the present invention shown secured to a wall.

In another alternative embodiment of the present invention, a key 90 may be secured to a wall 92 or similar support structure by a bolt 94 or similar securement means (FIGS. 5 and 8). In this embodiment of the invention, the cap assembly 78 may be engaged with a lock pin 96 secured to a resilient arm 98 of the key 90 and twisted to either remove or secure the cap assembly 78 to the container 12. In this embodiment of the present invention, a user can remove the cap assembly 78 from the container 12 with a single hand (not shown).

Although the invention has been described with respect to a preferred embodiment thereof, it is to be understood that it is not to be so limited, since changes and modifications can be made therein which are within the full intended scope of this invention as defined by the appended claims. For example, it is anticipated that any number, size and orientation of slots, indentations, and lock pins may be used in the apparatus 10.

What is claimed is:

1. A secured closure containment apparatus comprising:

(a) a container having at least one opening;

(b) a first cap including a top secured to a cylindrical sidewall, said sidewall of said first cap being provided with a catch wherein a portion of said cylindrical sidewall is positioned between said catch and said top;

(c) means for releasably securing said first cap opening;

(d) a second cap secured over said first cap, said second cap being with an opening;

(e) means provided on said second cap for providing torque transfer between said second cap and said first cap, wherein said torque transfer providing means is at least one sloped one-way catch provided on an interior surface of said second cap;

(f) means for transferring torque from said second cap to said first cap;

(g) wherein said transferring means is a key having a first end and a second end; and (h) wherein said second end of said key is of a construction small enough to extend through said opening of said second cap a sufficient distance to engage said catch provided on said first cap.

2. The secured closure containment apparatus of claim 1, wherein said releasable securing means are mating threads.

3. The secured closure containment apparatus of claim 1, further comprising means provided on said second cap for maintaining said first cap within said second cap.

4. A secured closure containment apparatus comprising:

(a) a container having at least one opening;

(b) a first cap including a top secured to a cylindrical sidewall, said sidewall of said first cap being provided with a catch, wherein said catch provided on said first cap is a perimeter of an opening extending through said first cap and wherein a portion of said cylindrical sidewall is positioned between said catch and said top;

(c) means for releasably securing said first cap over said opening;

(d) a second cap secured over said first cap, said second cap being provided with an opening; and (e) means provided on said second cap for providing torque transfer between said second cap and said first cap, wherein said torque transfer providing means is at least one sloped one-way catch provided on an interior surface of said second cap.

5. A secured closure containment apparatus comprising:

(a) a container having at least one opening;

(b) a first cap including a top secured to a cylindrical sidewall, said sidewall of said first cap being provided with a catch wherein said catch provided on said first cap is a perimeter of a recess provided in said first cap, wherein said perimeter does not extend through said first cap and wherein a portion of said cylindrical sidewall is positioned between said catch and said top;

(c) means for releasably securing said first cap over said opening;

(d) a second cap secured over said first cap, said second cap being provided with an opening; and (e) means provided on said second cap for providing torque transfer between said second cap and said first cap, wherein said torque transfer providing means is at least one sloped one-way catch provided on an interior surface of said second cap.

6. The secured closure containment apparatus of claim 1, further comprising means provided on said first cap for reducing torque transfer between said second cap and said first cap.

7. The secured closure containment apparatus of claim 6, wherein said means for reducing torque transfer between said second cap and said first cap is a smooth interior surface provided on said second cap.

8. A secured closure containment apparatus comprising:

(a) a container having a threaded opening;

(b) a first cap including a top secured to a cylindrical sidewall, said first cap having a threaded interior surface and an exterior surface, wherein said exterior surface is smooth and provided with a catch wherein a portion of said cylindrical sidewall is positioned between said catch and said top;

(c) a second cap having an interior surface and an exterior surface;

(d) wherein said interior surface of said second cap is smooth;

(e) wherein said second cap is provided with a cylindrical sidewall having an opening which extends through said second cap;

(f) wherein said first cap is provided within said second cap;

(g) wherein said second cap is provided with means for maintaining said first cap within said second cap;

(h) a key having a first end and a second end, wherein said second end is small enough to extend through said opening of said second cap a sufficient distance to engage said catch provided on said first cap;

(i) a first one-way catch provided on said interior surface of said second cap;

(j) a second one-way catch provided on said exterior surface of said first cap.

* * * * *